US005103107A

United States Patent [19]

Yamamoto et al.

[11] Patent Number: 5,103,107

[45] Date of Patent: Apr. 7, 1992

[54] STARTER MOTOR

[75] Inventors: Kyohei Yamamoto; Katunori Yagi; Takashi Kinoshita, all of Hyogo, Japan

[73] Assignee: Mitsubishi Denki K.K., Tokyo, Japan

[21] Appl. No.: 615,957

[22] Filed: Nov. 20, 1990

[30] Foreign Application Priority Data

Dec. 5, 1989 [JP] Japan ..... 1-140308
Dec. 5, 1989 [JP] Japan ..... 1-140309

[51] Int. Cl.[5] ..... F02N 11/00

[52] U.S. Cl. ..... 290/48; 200/302.1; 335/131

[58] Field of Search ..... 200/302.1; 290/48; 335/131

[56] References Cited

FOREIGN PATENT DOCUMENTS 18696 3/1989 Japan .

*Primary Examiner*—A. D. Pellinen
*Assistant Examiner*—Robert L. Hoover
*Attorney, Agent, or Firm*—Sughrue, Mion, Zinn, Macpeak & Seas

[57] ABSTRACT

In a starter motor, its electromagnetic switch has a movable contact cooperating with normally open contact member and normally closed contact member, and a part of a stationary contact in the normally closed contact member is formed into a locking piece to prevent the movable contact from contacting the passage formed in the cap of the switch, or the electromagnetic switch has a first movable contact cooperating with normally open contact member and a second movable contact cooperating with normally closed contact member, and an insulating partition wall is disposed between the first and second movable contacts, whereby the creeping distance between the normally open contact member and the normally closed contact member is increased as much, and the occurrence of current leakage is prevented.

3 Claims, 4 Drawing Sheets

STARTER MOTOR

BACKGROUND OF THE INVENTION

1. Filed of the Invention

This invention relates to starter motors, and more particularly to a start motor comprising a DC motor and an electromagnetic switch for controlling the latter, to start an engine.

2. Discussion of the Related Art

As shown in FIGS. 1 through 3, a conventional starter motor 1 comprises a DC motor 2 and an electromagnetic switch 3 for controlling the latter 2.

The magnetic poles 21 of the DC motor 2 are permanent magnets, which excite the armature 22. The positive and negative brushes 23 and 24 are held in slide contact with the armature 22.

The electromagnetic switch 3 has main contact means 31 which comprises: a movable iron core 32 with a movable contact 303; a pair of normally open stationary contacts 311 and 312 which are provided on one side of the movable contact 303; and a pair of normally closed stationary contacts 321 and 322 provided on the other side of the movable contact 303.

Upon energization of a current coil 33, the movable iron core 32 is attracted through a plunger 35, and it is held attracted by a voltage coil 34 which is connected in series to the current coil 33. The free end of the voltage coil 34 is grounded, while the free end of the current coil 33 is connected to the stationary contacts 312 and 322 which are grounded through the armature 22. The movable 32 core can be moved with the plunger 35.

The connecting point of the current coil 33 and the voltage coil 34 is connected to the positive terminal of a battery 4 through a key switch 5 on the vehicle.

The plunger 35 is engaged with a pinion which is spline- coupled to the output rotary shaft of the armature 22 with a shift lever (not shown).

The stationary contacts 311 and 312 are fixedly secured to a cap 37 which is coupled to the casing 36 of the electromagnetic switch 3. The stationary contact 321 is press-fitted in a core 38 provided in the casing 36 so that it is electrically connected to the core 38. The stationary contact 322 is formed by blanking a copper plate. The stationary contact 322 is connected through a lead wire 316 to the current coil 33, as shown in FIG. 2. The movable contact 303 is moved along a passage **37*a* formed in the cap 37 of the electromagnetic switch 3**.

When, in the starter motor thus constructed, the key switch 5 is closed, the current coil 33 and the voltage coil 34 are energized, so that the movable iron core 32 is moved in the direction of the arrow A, to connect the movable contact 303 to the stationary contacts 311 and 312. As a result, current is supplied from the battery 4 to the armature 22, so that the pinion is rotated to start the engine.

After the start of the engine, the key switch 5 is opened, the voltage coil 34 is deenergized to release the main contact means 31. As a result, the pinion is disengaged from the ring gear, while the movable contact is connected to the stationary contacts 321 and 322, to short the voltage generated by the inertial rotation of the armature 22 thereby to quickly stop the armature 22.

In the conventional starter motor, the electromagnetic switch is operated not only to start the motor but also to short the voltage generated by the inertial rotation of the armature (dynamic braking); that is, it is operated twice each starting operation, forming a relatively large quantity of contact abrasion powder. Leakage current flows through the contact abrasion powder thus formed, to damage components (particularly the cap) of the electromagnetic switch.

Furthermore, in the electromagnetic switch, as shown in FIG. 1, the creeping distance L between the stationary contact 311 on the battery side (being positive at all times) and the movable contact (being negative at all times except the starting time), and the creeping distance $L_2$ between the stationary contact 311 and the stationary contact 321 (being negative at all times) or 322 (being negative at all times except the starting time) are short, so that current leakage may occur during the period other than the engine starting time; i.e. when the engine is in operation or in pause.

Moreover, as indicated by the broken line in FIG. 3(*a*), the movable contact 303 can turn until it abuts, against the passage in the cap, and the creeping distance (L') is decreased as much. This short creeping distance together with the large quantity of contact abrasion powder allows leakage current to flow between the stationary contact 311 (being positive at all times) on the battery side and the movable contact 303 (being negative at all times except the starting time). More specifically, the stationary contacts 311 and 312 are exposed in the inner wall of the cap 37, and the stationary contact 311 is positive at all times. And, when the coils are deenergized, the movable contact 303 is negative. Therefore, if the movable contact 303 abuts against the cap passage **37*a*** during the deenergization of the coils, current leakage may occur to damage the cap of insulating material.

SUMMARY OF THE INVENTION

Accordingly, an object of this invention is to eliminate the above-described difficulty accompanying a conventional starter motor.

More specifically, an object of the invention is to provide a starter motor high in safety in which the occurrence of leakage current is prevented.

The foregoing object and other objects of the invention have been achieved by the provision of a starter motor comprising: an electric motor for producing torque to start an engine; and an electromagnetic switch including normally open contact means which, when a coil is energized, is closed to form a motor energizing circuit, and normally closed contact means which, when the coil is deenergized, is closed to short-circuit the positive and negative terminals of the electric motor, which, according to a first aspect of the invention, comprises: a locking piece integral with a stationary contact of the normally close contact means, to prevent a movable contact from rotation, or a starter motor comprising: an electric motor for producing torque to start an engine; and an electromagnetic switch having normally open contact means including a first movable contact which, when a coil is energized, forms a motor energizing circuit, and normally closed contact means including a second movable contact which, when the coil is deenergized, is closed to short-circuit the positive and negative terminals of the electric motor, which, according to a second aspect of the invention, comprises: a partition wall of insulating material disposed between the first and second movable contact.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings;

FIG. 3(*b*) is a side view of a part of the electromagnetic switch shown in FIG. 3(*a*);

FIG. 5(*b*) is a side view of a part of the electromagnetic switch shown in FIG. 5(*a*);

DETAILED DESCRIPTION OF THE INVENTION

Preferred embodiments of this invention will be described with reference to the accompanying drawings.

First Embodiment

Figure 4:
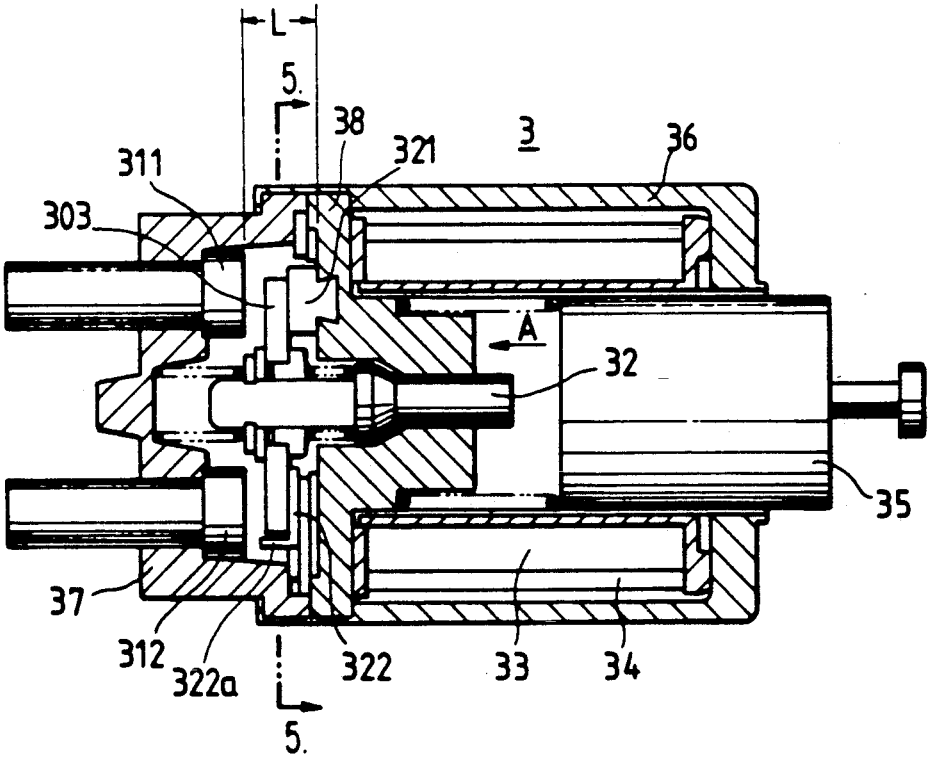
FIG. 4 is a sectional view showing an electromagnetic switch in a starter motor according to a first aspect of the invention.
Figure 5A:
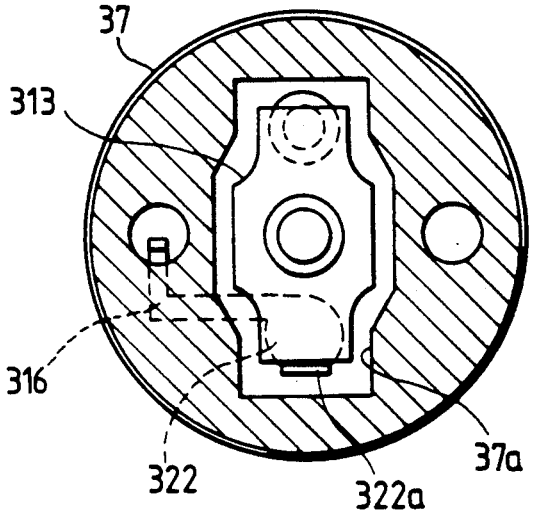
FIG. 5(*a*) is a sectional view taken along line 5—5 in FIG. 4.
Figure 5B:
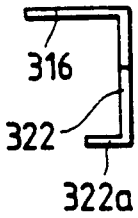

A starter motor according to a first aspect of this invention is as shown in FIGS. 4, 5(*a*) and 5(*b*). In the starter motor, its stationary contact 322 is formed by blanking a copper plate or the like. One end portion of the stationary contact 322 is bent to form a locking piece 322*a*, and the other end portion is formed into a connecting piece 316. In order to prevent the occurrent of leakage current, it is desirable that the area of the stationary contact 322 is minimized as much as possible. The other arrangement of the start motor according to the invention is the same as that of the above-described conventional starter motor.

In starting the engine, the starter motor thus constructed operates similarly as in the case of the above-described conventional start motor; however, it should be noted that the locking piece 322*a* prevents the turn of the movable contacts 303; that is, the movable contact 303 is not allowed to abut against the passage 37*a* of the cap 37. Hence, in the starter motor the creeping distance (L) is long, thus improving the security against the current leakage.

Effects

As was described above, in the start motor according to a first aspect of the invention, the turn of the movable contact is prevented, so that the latter will not contact with the passage formed in the cap; that is, the creeping distance is increased as much, which improves the security against the occurrence of current leakage.

Second Embodiment

A starter motor according to a second aspect of the invention will be described with reference to FIGS. 6 through 8.

Figure 7:
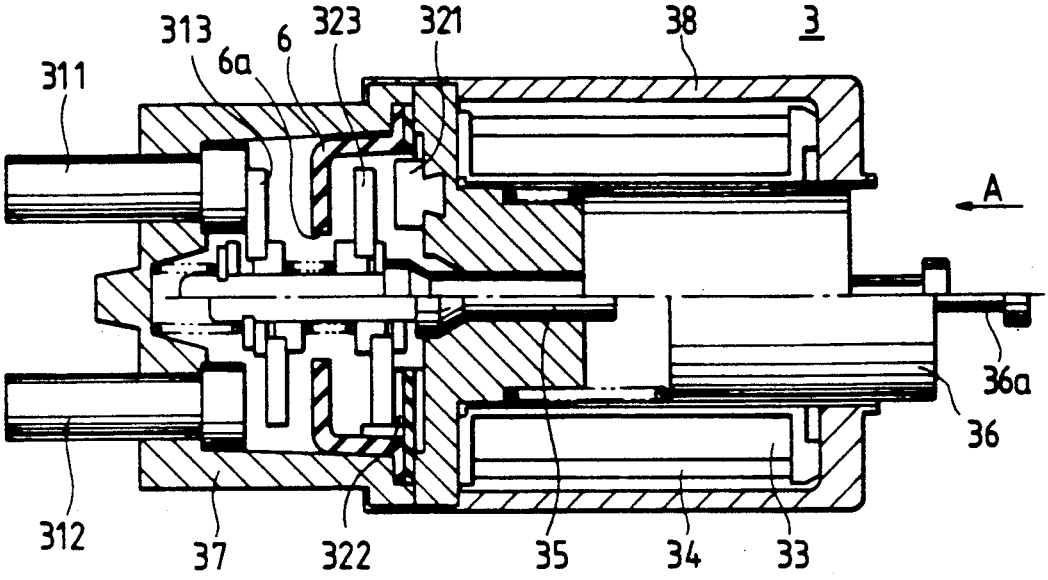
FIG. 7 is a sectional view of an electromagnetic switch in the starter motor shown in FIG. 6.

The lower half of FIG. 7 shows the state of the electromagnetic switch with the coils not energized, and the upper half shows the state of the electromagnetic switch with the coils energized. As shown in FIG. 7, first and second movable contacts 313 and 323 are fixedly mounted on a movable iron core 35 in such a manner that they are in parallel with each other. The first movable contact 313 confronts with stationary contacts 311 and 312, while the second movable contact 323 confronts with stationary contacts 321 and 322. A partition wall 6 of insulating material such as rubber is disposed between the first and second movable contacts 313 and 323.

Figure 8:
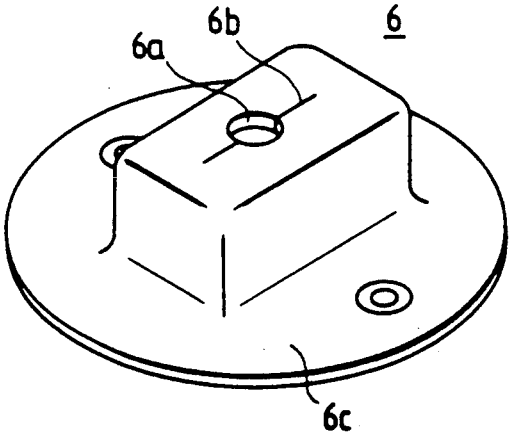
FIG. 8 is a perspective view of a partition wall in the electromagnetic switch.

The partition wall 6, as shown in FIG. 8, is in the form of a rectangular box with a flange 6*c*. A hole 6*a* larger in diameter than the outside diameter of the movable iron core 35, and a slit 6*b* for assembling work are formed in the bottom of the box. The flange 6*c* serves as a packing. The partition wall 6 can be passed over the first movable contact 313 when assembled.

The plunger 36 of the electromagnetic switch 3, which is moved by a current coil 33, has a hook 36*a*. Further in FIG. 7, reference numeral 37 designates a cap; and 38, a casing.

Figure 1:
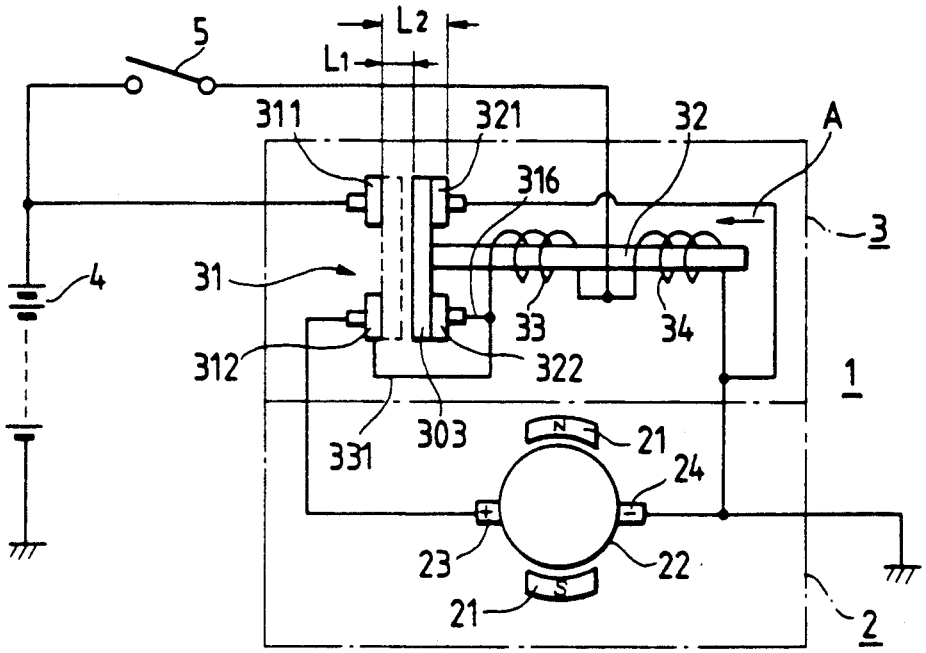
FIG. 1 PRIOR ART
FIG. 1 is a wiring diagram showing a conventional starter motor.
Figure 2:
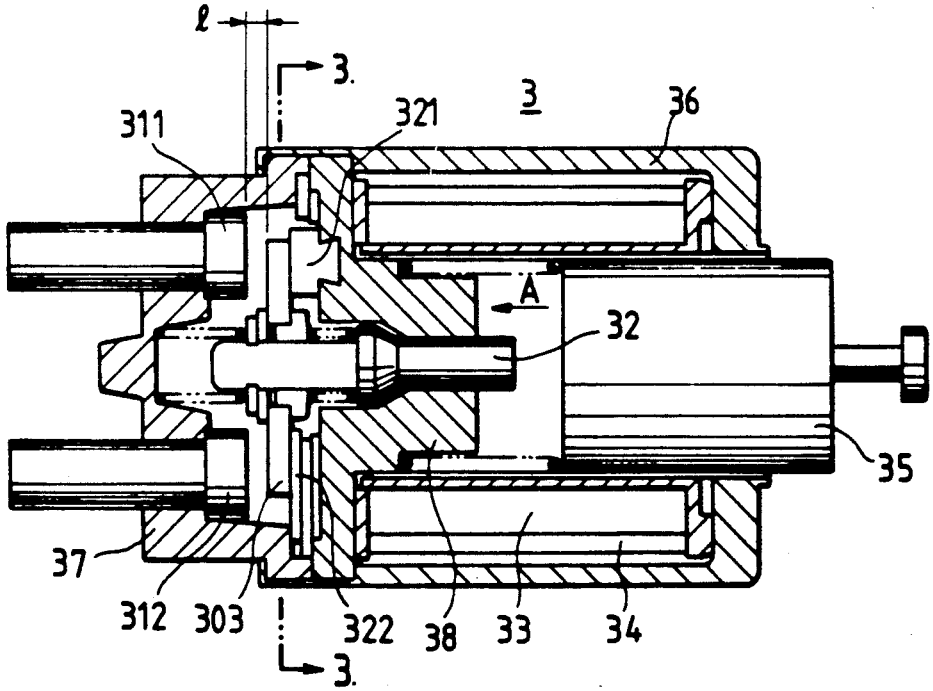
FIG. 2 PRIOR ART
FIG. 2 is a sectional view showing an electromagnetic switch in the conventional starter motor.
Figure 3A:
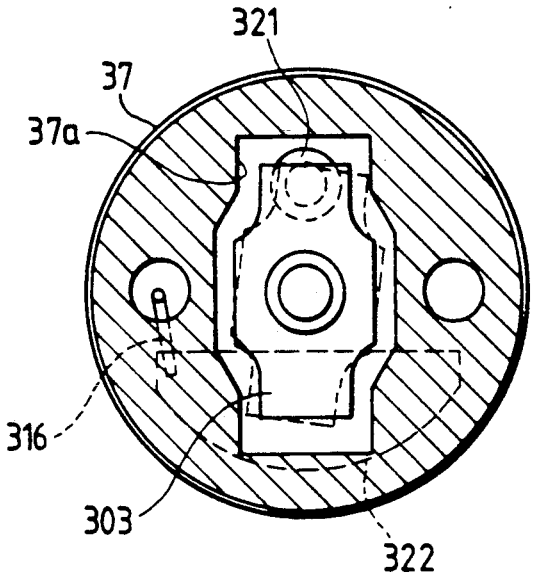
FIG. 3(a) PRIOR ART
FIG. 3(*a*) is a sectional view taken along line III—III in FIG. 2.
Figure 3B:
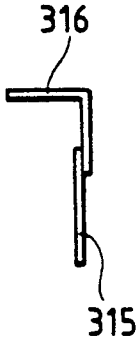
FIG. 3(b) PRIOR ART
Figure 6:
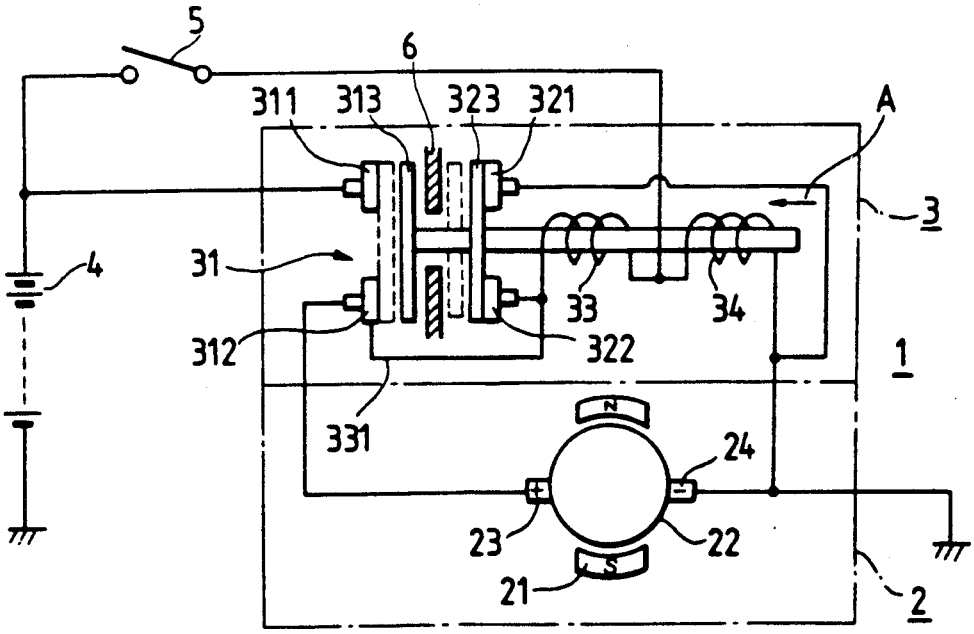
FIG. 6 is a wiring diagram showing a starter motor according to a second aspect of the invention.

In FIG. 6, those components which have been previously described with reference to FIG. 1 (the prior art) are therefore designated by the same reference numerals.

When, in the starter motor thus constructed, the key switch 5 is closed, the current coil 33 and the voltage coil 34 are energized to move the movable iron core 35 in the direction of the arrow A. As a result, the first movable contact 313 abuts against the stationary contacts 311 and 312, whereby the motor 2 is energized. Accordingly, the lever engaged with the hook 36*a* of the plunger 36 causes the pinion to engage with the ring gear of the engine, to start the latter.

When the key switch 5 is opened, the voltage generated by the inertial rotation of the motor is shorted with the route consisting of the components 23, 312, 331, 322, 323, 321 and 24; that is, dynamic braking is effected to stop the motor quickly.

The operation of the starter motor of the invention is fundamentally equal to that of the above-described conventional starter motor; however, it should be noted that the electromagnetic switch has the two movable contacts 313 and 323 cooperating with each other, and the partition wall 6 is provided between them so as to isolate the stationary contacts 311 and 312 from the stationary contacts 321 and 322, whereby the creeping distance which is directed to a distance from a positive contact to a negative contact along a surface of a structure is increased as much, and the occurrence of current leakage can be effectively prevented.

Figure 9:
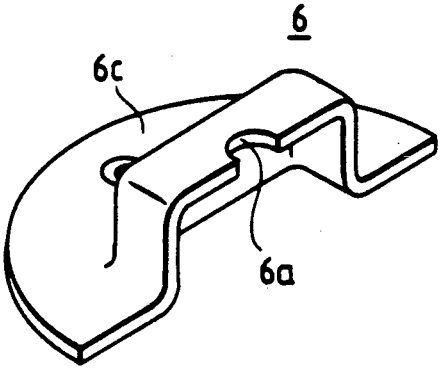
FIG. 9 is a perspective view showing one modification of the partition wall.

FIG. 9 shows one modification of the partition wall 6. The modification can be obtained by dividing the partition wall 6 shown in FIG. 8 into two parts. The modification is advantageous in that it can be made of hard material. That is, since the partition wall is made up of two parts, it can be positioned between the first and second movable contacts with ease even if it is made of hard material.

Effects

As was described above, the partition wall is provided between the first movable contact confronting the normally open stationary contacts and the second movable contact confronting the normally closed stationary contacts, so as to increase the creeping distance. As a result, the occurrence of current leakage is prevented, which contributes to the improvement of the safety of the starter motor.

The provision of the two movable contacts is effected in increasing of the service life of the starter motor.

The foregoing description of preferred embodiments of the invention has been presented for purposes of illustration and description. It is not intended to be exhaustive or to limit the invention to the precise from disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A starter motor comprising:

an electric motor for producing torque to start an engine; and an electromagnetic switch including;

normally open contact means which, when a coil is energized, is closed to form a motor energizing circuit, normally closed contact means which, when said coil is deenergized, is closed to short-circuit the positive and negative terminals of said electric motor, a movable contact means disposed between said open contact means and said closed contact means, and a locking piece integrally formed with a stationary contact of said normally closed contact means, to prevent said movable contact from rotation.

2. A starter motor comprising:

an electric motor for producing torque to start an engine; and an electromagnetic switch having;

a normally open contact means including a first movable contact which, when a coil is energized, forms a motor energizing circuit, a normally closed contact means including a second movable contact which, when said coil is deenergized, is closed to short-circuit the positive and negative terminals of said electric motor, and a partition wall of insulating material disposed between said first and second movable contact.

3. A starter motor according to claim 2, in which said partition wall is made up of at least one part.

* * * * *